United States Patent [19]

Ludwick

[11] Patent Number: 4,668,165

[45] Date of Patent: May 26, 1987

[54] SUPER GRIPPER VARIABLE VANE ARM

[75] Inventor: George E. Ludwick, Tequesta, Fla.

[73] Assignee: The United States of America as represented by the Secretary of the Air Force, Washington, D.C.

[21] Appl. No.: 844,636

[22] Filed: Mar. 27, 1986

[51] Int. Cl.[4] ..... F04D 29/56

[52] U.S. Cl. ..... 415/148; 415/151; 415/156

[58] Field of Search ..... 415/155, 158, 160, 163, 415/148, 150, 151, 156; 416/189

[56] References Cited

U.S. PATENT DOCUMENTS

| | | | |
|---|---|---|---|
| 1,245,810 | 11/1917 | Smith | 416/189 |
| 2,345,918 | 4/1944 | Dahlstrand | 416/189 |
| 3,356,288 | 12/1967 | Corsmeier | 230/114 |
| 3,584,458 | 6/1971 | Wetzler | 415/115 |
| 3,841,788 | 10/1974 | Sljusarev et al. | 415/160 |
| 3,954,349 | 5/1976 | Abild | 415/163 |
| 4,214,852 | 7/1980 | Tuley et al. | 415/115 |
| 4,363,600 | 12/1982 | Thebert | 415/156 |
| 4,400,135 | 8/1983 | Thebert | 415/134 |

FOREIGN PATENT DOCUMENTS

| | | | |
|---|---|---|---|
| 34907 | 4/1981 | Japan | 416/189 |

*Primary Examiner*—Robert E. Garrett
*Assistant Examiner*—John Kwon
*Attorney, Agent, or Firm*—William G. Auton; Donald J. Singer

[57] ABSTRACT

A variable vane assembly is disclosed which entails a vane arm which integrally engages with a vane stem without the use of threaded fasteners. The vane stem has a tip with parallel slots on opposite sides which are spaced below the end of the tip. At the end of the tip is an end slot which is perpendicular to the parallel slots. The tip of the vane stem has a ramped side parallel with the end slot. The vane arm is a flat wide metal strip that serves as the vane blade and integrally connects with the vane stem using two ears, which are turned inwards to engage with the parallel slots in the wave stem. Additionally, a central leaf exists between the two ears which turns downwards to fit in the end slot in the tip of the vane stem. The central leaf thereby acts as an axial retainer and allows the vane arm to be rotated with the rotation of the vane stem.

2 Claims, 4 Drawing Figures

SUPER GRIPPER VARIABLE VANE ARM

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to gas turbine engines, and more specifically to a variable vane for use in such engines in which the vane arm is integrally engaged with the vane stem in a manner that eliminates the need for threaded fasteners, lockwashers and lockwires.

In gas turbine engines, energy is added to the air through the process of compression, while energy is extracted during combustion by means of the turbine. In a turbofan engine, compression is accomplished sequentially using a fan and thereafter using a multistage compressor; the fan and compressor being independently driven by a high pressure and a low pressure turbine, respectively, through concentric shaft connections. Combustion occurs between the multistage compressor and the high pressure turbine. Since the energy available to the turbines far exceeds that required to maintain the compression process, the excess energy is exhausted as high velocity gases through one or more nozzles at the rear of the engine to produce thrust.

Variable turbine vanes have been developed in order to regulate their relative rotational speeds. Exemplary in the art, are the systems disclosed in the following U.S. Patents, the disclosures of which are incorporated by reference:

U.S. Pat. No. 3,356,288 issued to Corsmeier;
U.S. Pat. No. 3,954,349 issued to Abild;
U.S. Pat. No. 4,400,135 issued to Thebert; and
U.S. Pat. No. 4,214,852 issued to Tuley et al.

The references cited above disclose turbine engines with variable vane systems which regulate the rotation of the turbines. For example, Turley et al disclose a turbine vane assembly in which the vanes have variable areas. In such a system, each vane is fixed by a vane arm to its crank. All of the references disclose conventional means of attaching the arm to the crank, which include threaded fasteners, lockwashers, lockwires, and clevis pins. Since each turbine engine includes a plurality of rows of rotating turbine blades enclosed in a confined space, the initial construction and subsequent maintenance of such blades is an awkward and cumbersome process.

From the foregoing discussion, it is apparent that there currently exists a need of attaching the stator vanes of gas turbine engines to their radial crank without the use of threaded fasteners and their attendant locking mechanisms. The present invention is intended to satisfy that need.

SUMMARY OF THE INVENTION

The present invention provides a variable vane arm which is integrally engaged with its vane stem within the housing of a gas turbine engine in a manner that eliminates the need for threaded fasteners. Each turbine blade terminates in a vane arm which integrally locks over a central vane stem which rotates the vane.

The structure end of the vane stem is provided with a sloping surface, or inclined ramp, two parallel slots on opposite sides spaced from the end of the stem and a single slot across the end of the stem. The vane arm is a flat, relatively wide metal strip of constant width having two ears or "grippers" near one end which are turned inward to engage, respectively, the two slots in the vane stem. The vane arm also has a leaf, the end of which is turned downwardly approximately 90 degrees to engage the slot in the end of the stem and serve as the axial retainer. The ramp on the end of the stem facilittes the installation of the arm on the stem.

It is an object of the present invention to provide a variable vane assembly for gas turbine engines which eliminates a need for threaded fasteners between each vane arm and its rotating vane stem.

It is another object of the present invention to provide a variable vane assembly which allows the vane arms to be easily installed on their vane stems.

It is another object of the present invention to provide a means of attaching turbine vanes arms to the vane stem in a manner which adds to the torque capability of each arm.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a construction for a variable vane in a turbine and specifically describes and illustrates the connection between the stem of the vane and the vane arm. The arrangement eliminates the threaded fasteners, lockwashers, and lockwires which were previously used.

Figure 1:
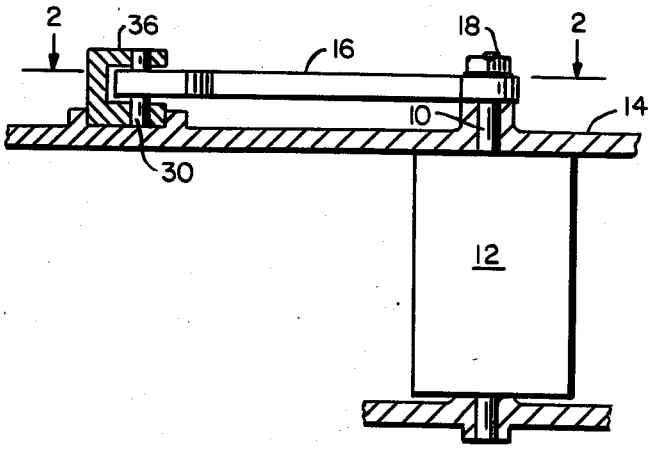
FIG. 1 PRIOR ART
FIG. 1 is a fragmentary sectional view of a prior art vane structure.

The reader's attention is now directed towards FIG. 1, which is a fragmentary sectional view of a prior art vane structure originally presented in the Abild reference. Referring to FIG. 1, the stub shaft 10 projecting from the outer end of the vane 12 is pivoted in the compressor casing 14 and has mounted on the outer end an actuating lever 16, being held thereon as by a nut 18. Such a construction is well known in the art as also indicated by the Corsmeier U.S. Pat. No. 3,356,288.

Figure 2:
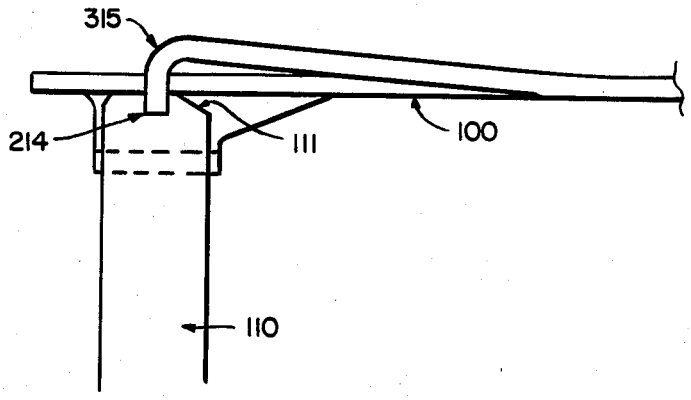
FIG. 2 is a side view of the vane assembly of the present invention.
Figure 3:
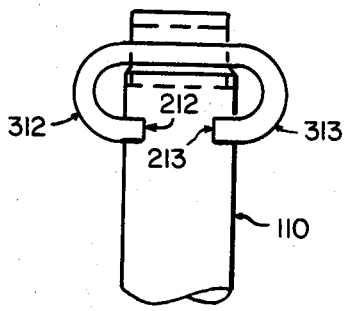
FIG. 3 is an end view of the vane assembly of FIG. 2.
Figure 4:
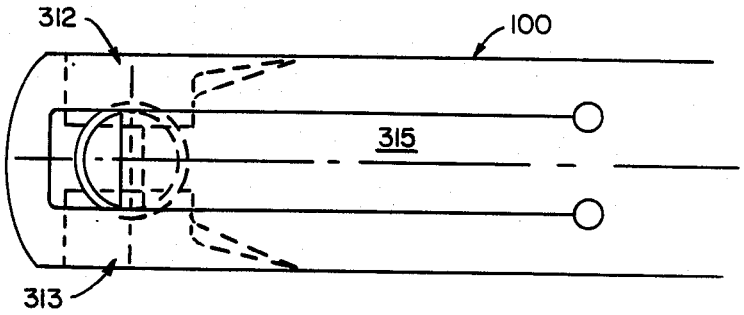
FIG. 4 is a plan view of the vane assembly of FIG. 3.

FIGS. 2, 3 and 4 are different views of the variable vane construction of the present invention. FIG. 2 is a side view of the vane structure which illustrates how the vane arm 100 integrally fits into the vane stem 110 without the use of threaded fasteners.

As seen in FIG. 2, the end of the vane stem 110 has a sloping surface or inclined ramp 111, the function of which is described in the installation description presented below. The vane stem 110 also has two parallel slots 212,213 on opposite sides of it which are spaced from the end of the stem, and a single end slot 214 across its end which is perpendicular to the two parallel slots 212 and 213.

The vane arm 100 is a flat, wide metal strip of constant width which terminates the variable vanes of a gas turbine engine, and is designed to integrally fit onto the vane stem 110 without threaded fasteners. The vane arm 110 has two ears 312 and 313 which are turned inwards to serve as grippers by engaging the two parallel slots 212 and 213 in the vane stem 110. FIG. 3 is an end view of the assembly of FIG. 2 and FIG. 4 is a plan view of the assembly of FIG. 2. FIGS. 3 and 4 are included to depict how the grippers 312 and 313 engage the vane stem.

The vane arm is also equipped with a central leaf 315 which turns downwards approximately 90 degrees between the grippers to engage the end slot 214 at the end of the vane stem 110. This leaf is labeled as an axial retainer in FIG. 2, since it acts as an angled screwdriver, and adds to the torque capability of the arm.

Installation of this vane arm 110 is accomplished by pushing it onto the vane stem 110 from the right, as seen from FIG. 2. The axial retainer then rides up the ramp and snaps into the vane end slot acting as an angle screwdriver and adding to the torque capability of the arm. Because all arms are attached to the synchronizing ring at the right hand end, a multiple failure or disengagement of the axial retainer woudl be required to render any arm inoperable. This scheme eliminates the threaded fasteners lockwashers, lockwires and other locking features required by more conventional arms.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In combination with a turbine engine, a variable vane assembly comprising:

a vane stem which may be rotated, said vane stem having a tip with first and second parallel slots on opposite sides of it spaced below the vane stem's tip, said vane stem having an end slot in the tip, said end slot, being perpendicular to the first and second parallel slots; and a vane arm which integrally fits on the tip of the vane stem without threaded fasteners, said vane arm thereby being capable of being rotated by said vane stem within said turbine engine, said vane arm comprising a flat wide metal strip with two ears near one end, said ears being outer edges of the metal strip which are turned outwards to engage the first and second parallel slots in said vane stem, said metal strip also having a central leaf which turns downwards between the two ears to engage the end slot in the tip of the vane stem, said central leaf thereby serving as an axial retainer as said vane stem rotates said vane arm.

2. A variable vane assembly, as defined in claim 1, wherein said vane stem includes, a ramped side on the tip which is parallel to the end slot, said ramped side facilitating installation of the vane arm by allowing the central leaf of the vane arm to ride up the ramped side into position in the end slot when the vane arm is pushed onto the vane stem.

* * * * *